US007389734B2

(12) United States Patent
Takahashi et al.

(10) Patent No.: US 7,389,734 B2
(45) Date of Patent: Jun. 24, 2008

(54) HORIZONTAL ROTARY HOOK FOR SEWING MACHINE

(75) Inventors: Masakazu Takahashi, Tochigi (JP); Shin Ota, Aichi (JP); Katsuhiro Kitajima, Gifu (JP); Toshio Abe, Aichi (JP)

(73) Assignees: E. I. du Pont de Nemours and Company, Wilmington, DE (US); Brother Kogyo Kabushiki Kaisha, Aichi-Ken (JP)

( * ) Notice: Subject to any disclaimer, the term of this patent is extended or adjusted under 35 U.S.C. 154(b) by 91 days.

(21) Appl. No.: 11/284,165

(22) Filed: Nov. 21, 2005

(65) Prior Publication Data

US 2006/0150878 A1 Jul. 13, 2006

(30) Foreign Application Priority Data

Nov. 24, 2004 (JP) ..... 2004-338540

(51) Int. Cl.
*D05B 57/16* (2006.01)
*D05B 57/00* (2006.01)

(52) U.S. Cl. ..... 112/230

(58) Field of Classification Search ..... 112/181, 112/184, 185, 189, 191, 193, 196, 228, 230, 112/231

See application file for complete search history.

(56) References Cited

U.S. PATENT DOCUMENTS 3,016,033 A 1/1962 Harbst
3,140,681 A * 7/1964 Corey ..... 112/228
3,223,060 A 12/1965 Corey
3,390,653 A * 7/1968 Ketterer ..... 112/228
4,638,750 A * 1/1987 Mikuni ..... 112/230
4,660,487 A 4/1987 Mikuni
4,966,088 A 10/1990 Badillo
5,015,034 A * 5/1991 Kindig et al. ..... 297/227
5,427,042 A 6/1995 Yamasaki
5,517,775 A * 5/1996 Kurtz ..... 38/102.91
5,617,803 A * 4/1997 Badillo ..... 112/230
6,807,918 B2 * 10/2004 Chang ..... 112/230

FOREIGN PATENT DOCUMENTS

JP A-S58-97390 6/1983
JP U-S60-149388 10/1985

OTHER PUBLICATIONS

PCT International Search Report and Written Opinion for International Application No. PCT/US2005/042851 dated Mar. 27, 2006.

* cited by examiner

*Primary Examiner*—Ismael Izaguirre

(57) ABSTRACT

A horizontal rotary hook for a sewing machine includes a bobbin case holder accommodating a bobbin, a rotating hook made of a synthetic resin, and accommodating the bobbin case holder and rotated in a predetermined direction, the rotating hook including a peripheral wall and a peripheral end, a needle-thread passing opening formed in the peripheral wall of the rotating hook so as to be defined at least by a peripheral end of the peripheral wall, and a reinforcing rib provided on the peripheral wall of the rotating hook so as to be located in the vicinity of the peripheral end defining the needle-thread passing opening.

9 Claims, 9 Drawing Sheets

HORIZONTAL ROTARY HOOK FOR SEWING MACHINE

CROSS-REFERENCE TO RELATED APPLICATIONS

This application is based upon and claims the benefit of priority from the prior Japanese Patent Application No. 2004-338540, filed on Nov. 24, 2004, the entire contents of which are incorporated herein by reference.

TECHNICAL FIELD

The disclosure relates to a horizontal rotary hook for a sewing machine which includes an inner bobbin case holder for accommodating a bobbin and an outer rotating hook for accommodating the bobbin case holder, and more particularly to such a horizontal rotary hook in which the rotating hook includes a peripheral wall having an end defining a needle-thread passing opening.

BACKGROUND

A horizontal rotary hook providing an easy replacement of a bobbin has conventionally been used in sewing machines. The horizontal rotary hook comprises an outer rotating hook having a sliding surface and an inner bobbin case holder accommodating a thread bobbin therein and supported in the rotating hook so as to be rotatable relative to the sliding surface. The rotating hook is formed into a cylindrical container with an upper opening. The rotating hook includes a peripheral wall on which a loop seizing beak is provided for seizing a loop of needle thread and which has a needle-thread passing opening through which a needle thread seized by the beak passes. The rotating hook is rotated in a predetermined direction by a sewing machine motor.

The bobbin case holder is made of a synthetic resin so that a reduction is achieved in the weight and production cost thereof. Furthermore, the rotating hook has also been made of a synthetic resin recently. For example, JP-U-S60-149388 discloses a horizontal rotary hook in which a beak member necessitating durability is made of a metal and mounted on the rotating hook so as to be laid on an inner surface of the peripheral wall of the rotating hook. Furthermore, JP-A-S58-97390 discloses a horizontal rotary hook in which a separate hook beak and a separate needle guard (a beak member) are disposed in an opening defined in the peripheral wall of the rotating hook to be mounted to the peripheral wall by small screws. The document discloses nothing about a material for the rotating hook.

However, the peripheral wall of the rotating hook is made of a synthetic resin in the horizontal rotary hook disclosed by the former reference, JP-U-S60-149388. Accordingly, an end of the rotating hook defining the needle-thread passing opening particularly has a low strength, so that there is a possibility that the end may be deformed or broken. On the other hand, in the horizontal rotary hook disclosed by the latter reference, JP-A-S58-97390, a part of the peripheral wall near the opening has an excessively large thickness, whereupon a predetermined strength is ensured. However, this results in another problem that a size of the rotating hook is increased.

SUMMARY

Therefore, an object of the disclosure is to provide a horizontal rotary hook for a sewing machine, in which the rotating hook is made of a synthetic resin and the strength of the peripheral wall of the rotating hook can be increased while an increase in the size of the rotating hook can be limited.

In one aspect, the disclosure provides a horizontal rotary hook for a sewing machine, comprising a bobbin case holder accommodating a bobbin, a rotating hook made of a synthetic resin, and accommodating the bobbin case holder and rotated in a predetermined direction, the rotating hook including a peripheral wall and a peripheral end, a needle-thread passing opening formed in the peripheral wall of the rotating hook so as to be defined at least by a peripheral end of the peripheral wall, and a reinforcing rib provided on the peripheral wall of the rotating hook so as to be located in the vicinity of the peripheral end defining the needle-thread passing opening.

Since the reinforcing rib is formed in the vicinity of the peripheral end defining the needle-thread passing opening of the rotating hook, the strength of the end of the peripheral wall facing the opening can be increased while an increase in the thickness of the peripheral wall of the rotating hook is limited. Furthermore, the entire size of the horizontal rotary hook can be prevented from being increased and accordingly, the production cost can be reduced.

In another aspect, the disclosure provides a horizontal rotary hook for a sewing machine, comprising a bobbin case holder accommodating a bobbin, a rotating hook made of a synthetic resin, and accommodating the bobbin case holder and rotated in a predetermined direction, the rotating hook including a peripheral wall and a peripheral end, a needle-thread passing opening formed in the peripheral wall of the rotating hook so as to be defined at least by a first peripheral end of the peripheral wall, an enlarged opening formed in the peripheral wall of the rotating hook so as to be defined at least by a second peripheral end of the peripheral wall of the rotating hook and so as to be continuous to the needle-thread passing opening, a beak member separate from the rotating hook and mounted on the rotating hook so as to close the enlarged opening, and a reinforcing rib provided on the peripheral wall of the rotating hook so as to be located in the vicinity of at least one of the first peripheral end defining the needle-thread passing opening and the second peripheral end defining the enlarged opening.

The beak member is mounted on the rotating hook so as to close the enlarged opening although the beak member is separate from the rotating hook. Accordingly, since the peripheral wall and the beak member are avoided being laid on each other, the size of the rotating hook can be prevented from being increased. Furthermore, provision of the reinforcing rib can increase the strength of the end of the peripheral wall facing the needle-thread passing opening and the enlarged opening while an increase in the thickness of the peripheral wall of the rotating hook is limited.

Furthermore, the aforesaid reinforcing rib may be provided on an inner surface of the peripheral wall. As a result, an outward force applied to the peripheral wall, namely, a tensile stress applied to the reinforcing rib can sufficiently be coped with, whereupon high reinforcing effect can be achieved. Furthermore, the reinforcing rib may be formed into a generally triangular shape. Additionally, when being sized so that a gap is defined between a sewing needle and the reinforcing rib in sewing, the reinforcing rib can be prevented from interference with the sewing needle.

BRIEF DESCRIPTION OF THE DRAWINGS

Other objects, features and advantages of the present invention will become clear upon reviewing the following description of the illustrative aspects with reference to the accompanying drawings, in which.

DETAILED DESCRIPTION OF THE INVENTION

Several embodiments of the invention will be described with reference to the accompanying drawings. FIGS. 1A to 12 show a first embodiment of the invention. The invention is applied to a horizontal full rotary hook in which an outer rotating hook is continuously rotated in one direction.

Figure 1A:
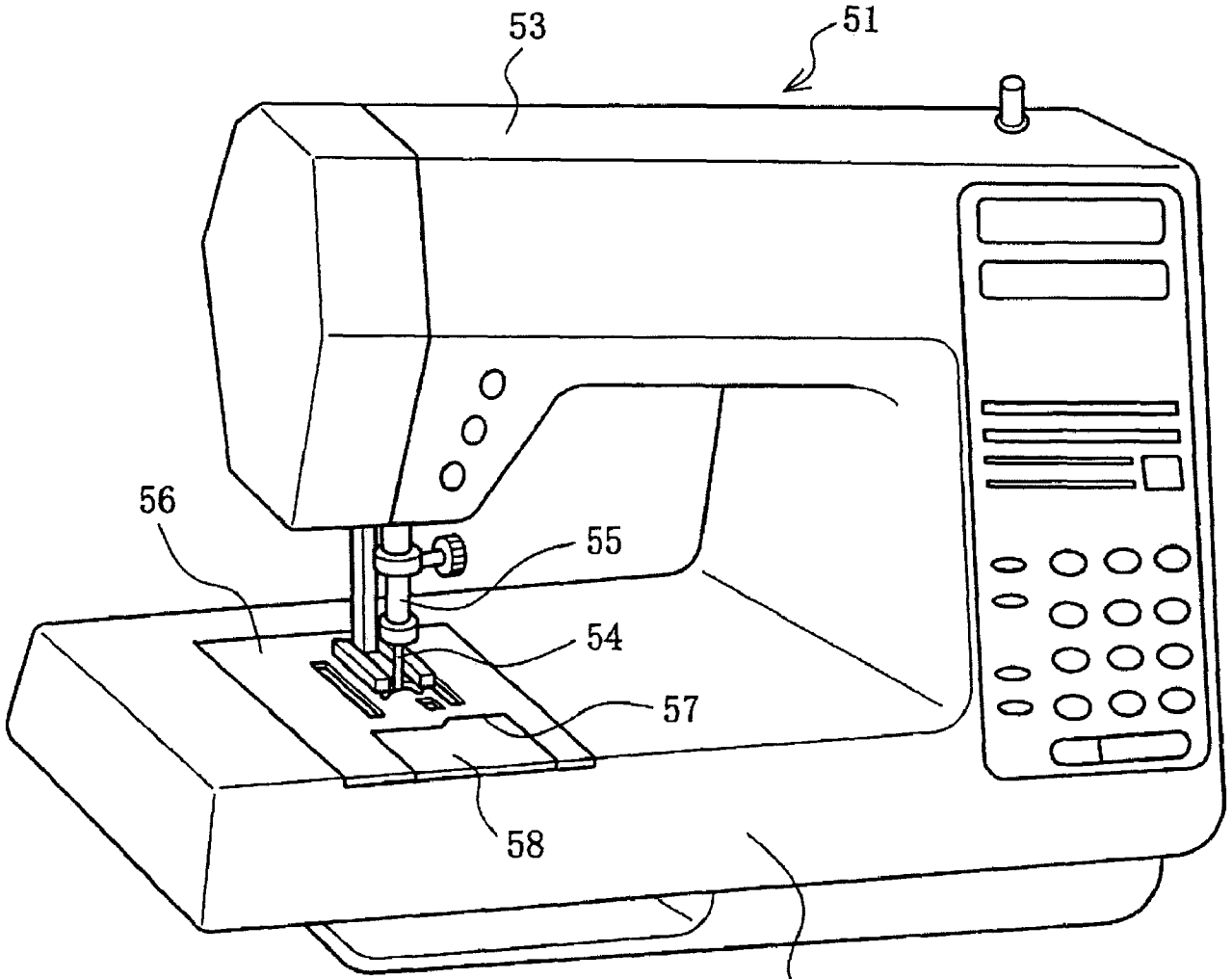
FIG. 1A is a perspective view of a sewing machine according to a first illustrative aspect of the invention.
Figure 1B:
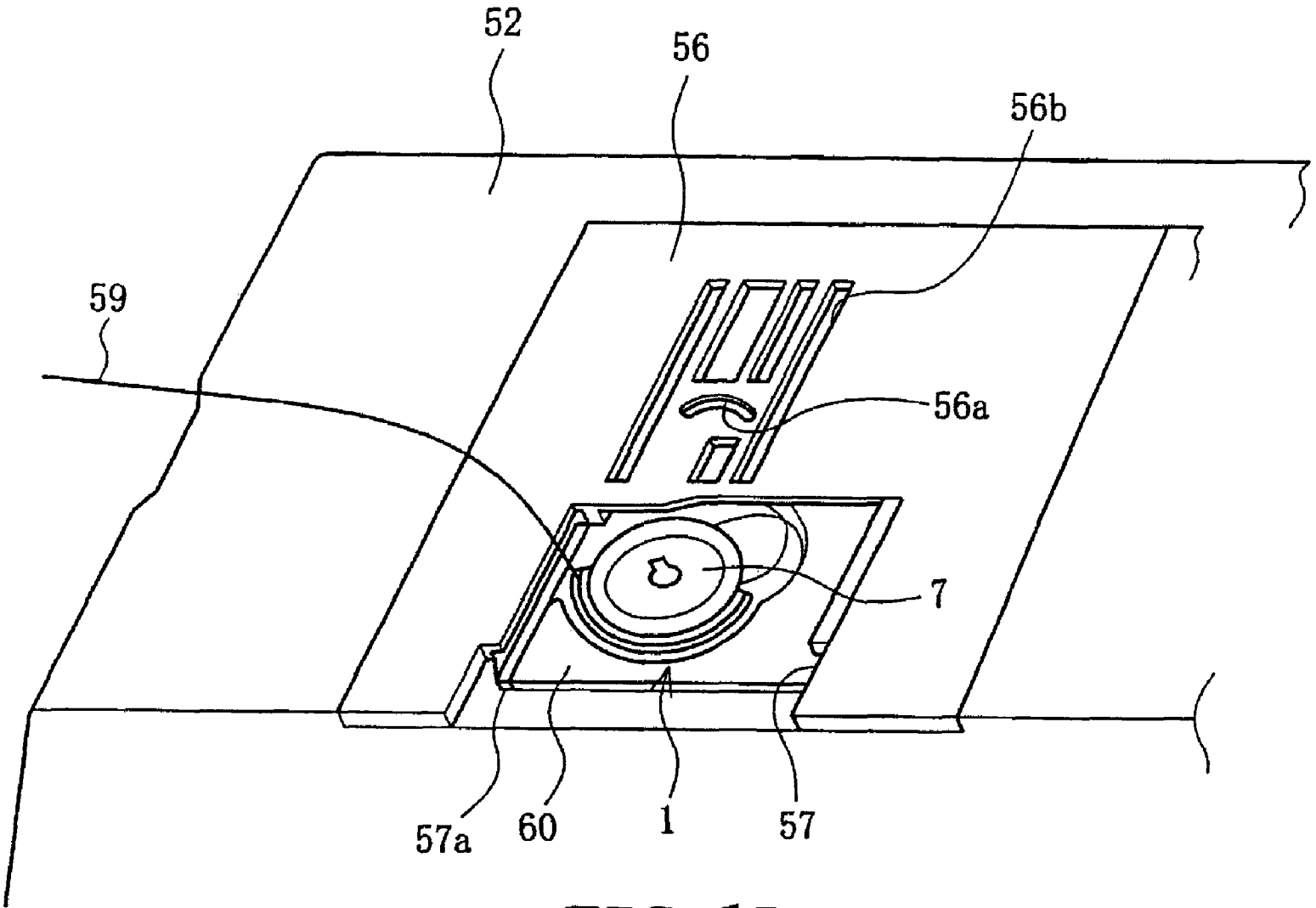
FIG. 1B is an enlarged perspective view of a needle plate.

Firstly, an overall construction of a sewing machine provided with the horizontal full rotary hook of the first embodiment will be described. The sewing machine comprises a body 51 including a sewing bed 52 and a sewing arm 53 formed integrally with the bed so as to be mounted over the bed as shown in FIG. 1A. The arm 53 has a distal end having a needle bar 55 provided with a sewing needle 54. A needle bar 55 is moved vertically by a driving mechanism (not shown). On the other hand, a metal needle plate 56 is mounted on an upper surface of the bed 52 so as to be opposed to the needle bar 55 as shown in FIG. 1B. The needle plate 56 has a needle hole through which the needle 54 passes and a plurality of elongate slits 56*b* for actuation of a feed dog (not shown). Further, the needle plate 56 has a rectangular bobbin-accommodating hole 57 located in front of the needle hole 56*a* and the elongate slits 56*b*. The bobbin-accommodating hole 57 has two slide grooves 57*a* formed in right and left portions thereof (only the left slide groove being shown) respectively. A transparent slide lid 58 (see FIG. 1A) is adapted to be inserted into the grooves 57*a* so as to be slidable front and back, thereby closing and opening the bobbin-accommodating hole 57.

A cloth feed mechanism (not shown) is provided inside the bed 52 for driving the feed dog in synchronization with the vertical movement of the needle bar 55. Further, a horizontal full rotary hook 1 of the embodiment is located below the bobbin-accommodating hole 57. The horizontal full rotary hook 1 includes a beak member 5 and an outer rotating hook 3 (see FIG. 2) horizontally rotated in synchronization with the vertical movement of the needle bar 55 and an inner bobbin case holder 2 (see FIG. 2). A bobbin 7 on which a bobbin thread 59 is wound is detachably accommodated in the inner rotating hook bobbin case holder 2 as shown in FIG. 1B. A plastic presser plate 60 is mounted on the underside of the needle plate 56 so as to be located in the bobbin-accommodating hole 57. The presser plate 60 has an opening through which the bobbin 7 is put into and taken out of the bobbin case holder 2. The presser plate 60 further has an engagement portion (not shown) formed on the underside thereof for engaging a rotation limiter 12 of the bobbin case holder 2, which limiter 12 will be described later.

In the sewing machine thus constructed, when the rotating hook 3 is rotated counterclockwise in synchronization with the vertical movement of the needle bar 55, a loop of needle thread (not shown) formed by a sewing needle 54 below an eye 56*a* of the sewing needle is caught by a loop seizing beak member 5. This direction of rotation will hereinafter be referred to as "hook rotating direction A." The thread loop is then entangled with the bobbin thread 59 while being passed outside the bobbin case holder 2, whereby a stitch is formed.

Figure 2:
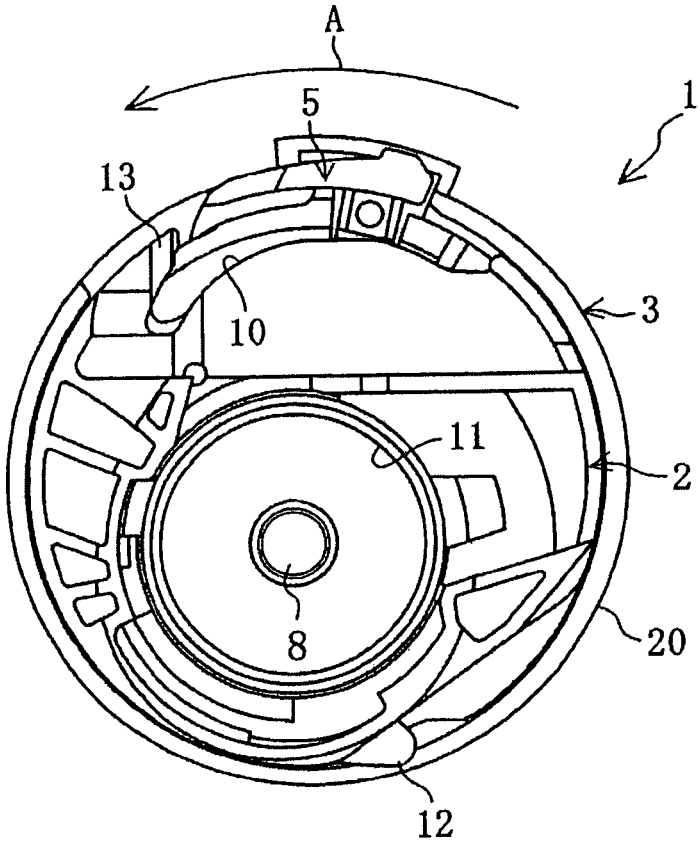
FIG. 2 is a plan view of a horizontal full rotary hook.
Figure 3:
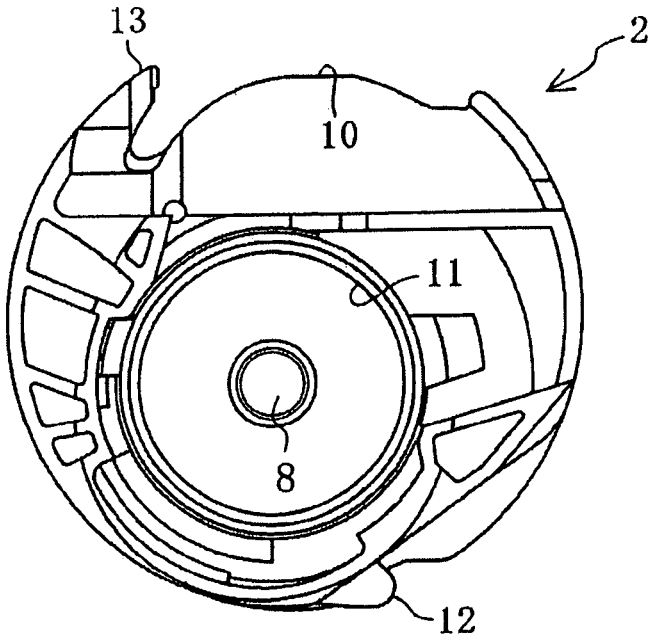
FIG. 3 is a plan view of an inner bobbin case holder.

The horizontal full rotary hook 1 will now be described in detail with reference to FIGS. 2 to 12. The bobbin case holder 2 will first be described. Referring to FIGS. 2 and 3, the bobbin case holder 2 is made of a synthetic resin such as nylon resin and formed into the shape of a substantially cylindrical shallow container. An interior of the bobbin case holder 2 serves as a bobbin-accommodating section 11 for accommodating the bobbin 7. The bobbin case holder 2 has a bottom with a centrally formed shaft 8 with which the bobbin 7 is to be fitted.

Referring to FIG. 3, the bobbin case holder 2 includes an outer periphery formed with the rotation limiter 12 located at the front as viewed in FIG. 3 and preventing rotation of the bobbin case holder 2. The outer periphery of the bobbin case holder 2 is further formed with a notch 10 located at an inner side as viewed in FIG. 3 and allowing the needle 54 to pass through the notch. The notch 10 has one end formed with a protruding thread guide 13. Further, the bobbin-accommodating section 11 has an inner wall provided with a tensioning member (not shown) for tensioning a bobbin thread 59. The tensioning member comprises a thread tension bracket and a tension spring both of which are formed into an arc-shaped plate and mounted on the inner wall of the bobbin-accommodating section 11 in a superposed state.

Figure 5:
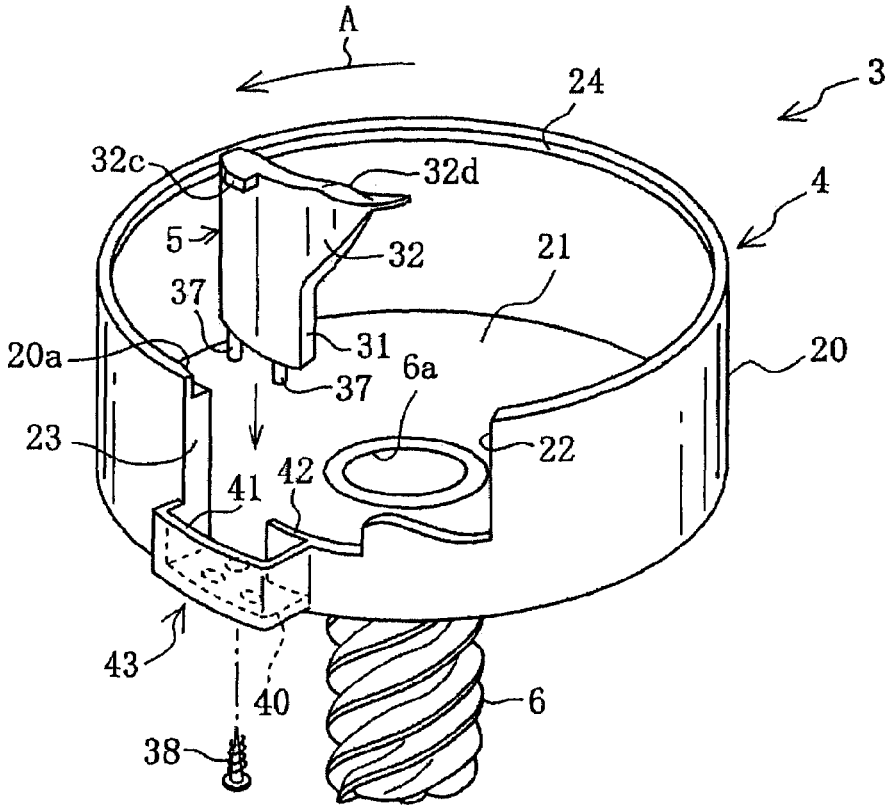
FIG. 5 is a perspective view of the rotating hook with a beak member being shown in an exploded state.
Figure 6:
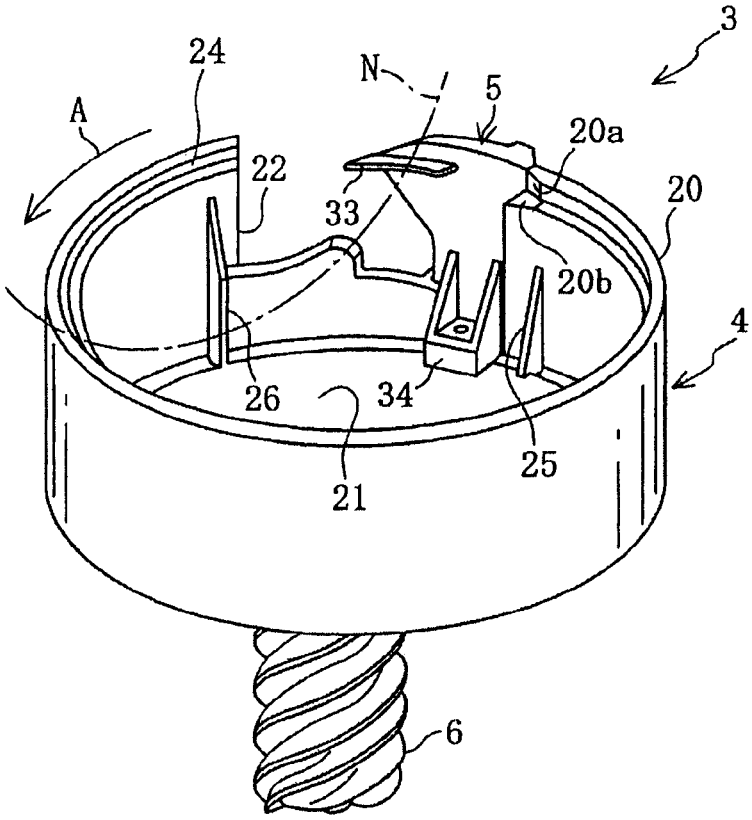
FIG. 6 is a perspective view of the rotating hook as taken from an angle different from FIG. 5.

Next, the rotating hook 3 will be described. Referring to FIGS. 5 and 6, the rotating hook 3 includes a cylindrical receptacle-shaped hook body 4 having an open top, a beak member 5 to be mounted on the hook body 4 and a drive shaft 6 extending downward from the central underside of the hook body 4. In the embodiment, the hook body 4 and the drive shaft 6 are each made of a synthetic resin such as nylon resin and are formed integrally with each other, for example, by injection molding. The beak member 5 is made of a synthetic resin such as polyimide resin. The material of the beak member 5 has a higher hardness than the material of the hook body 4. Thus, since the beak member 5 is made of the synthetic resin, the beak member 5 can easily be made as a formed part, and the production cost of the beak member 5 can be reduced as compared with a beak member made of a metal.

Figure 7:
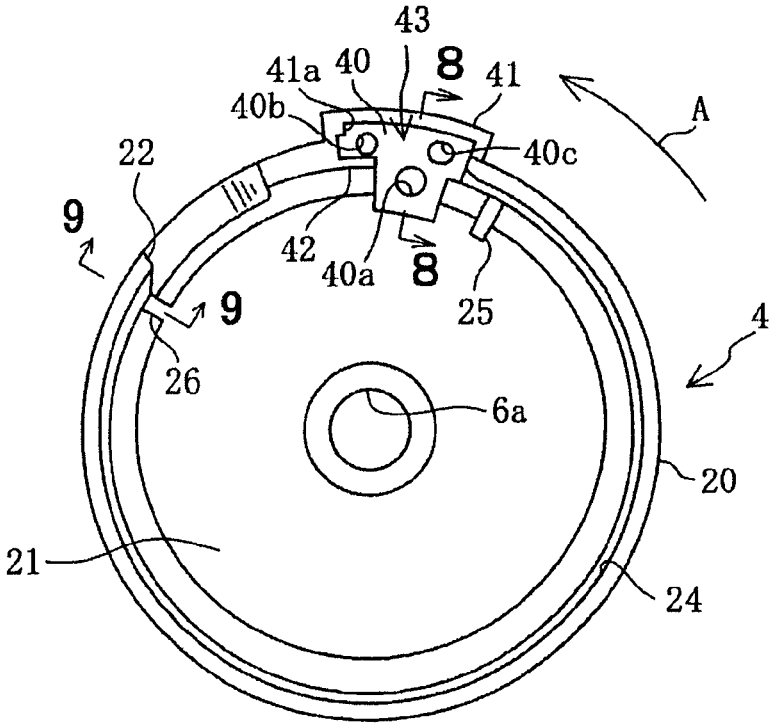
FIG. 7 is a view similar to FIG. 4, showing the condition before a beak member is attached to the rotating hook.
Figure 11:
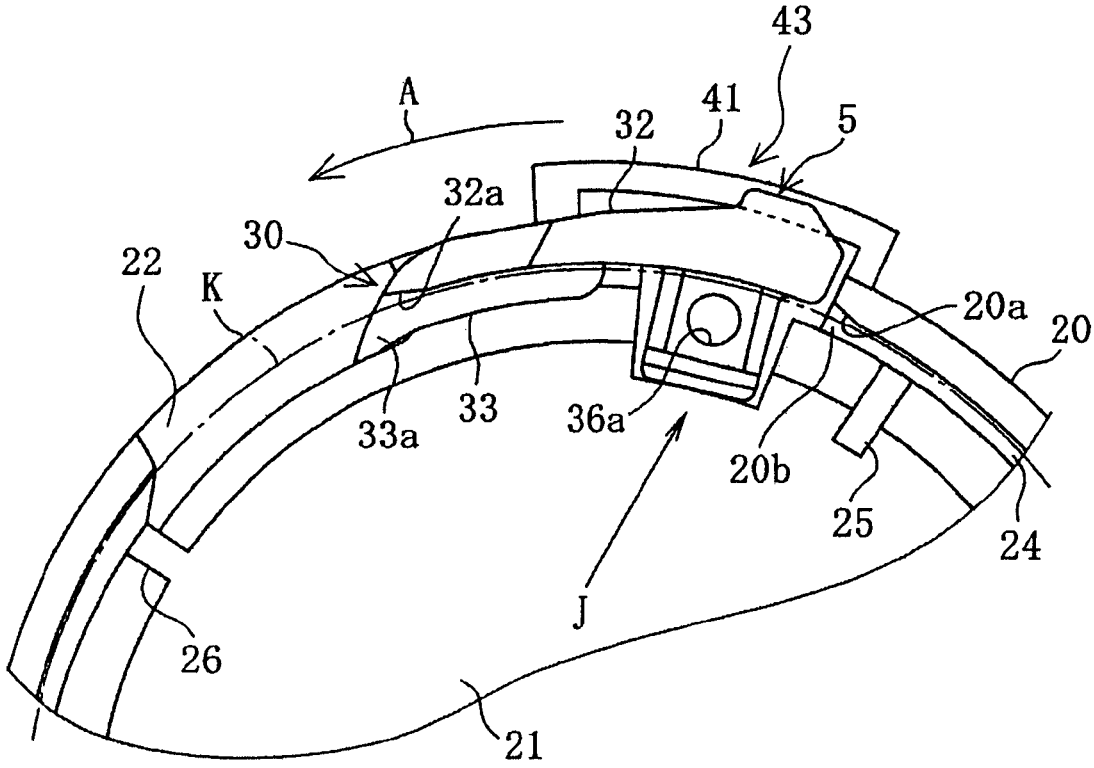
FIG. 11 is an enlarged plan view of the beak.
Figure 12:
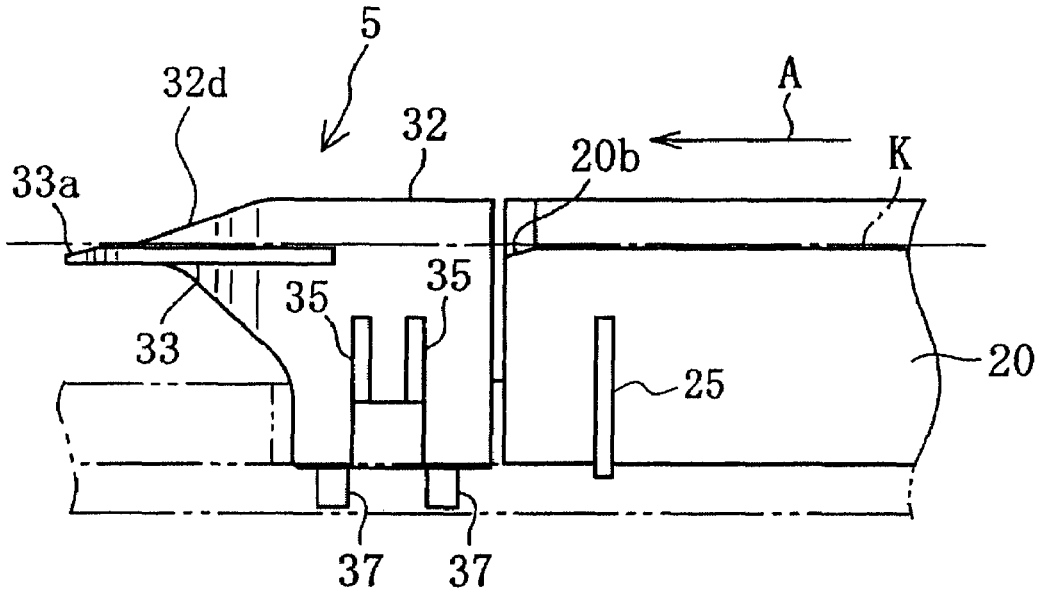
FIG. 12 is a view as viewed in the direction of arrow J in FIG. 11.

Referring now to FIGS. 4 to 7, the hook body 4 has a disc-shaped bottom 21 and a peripheral wall 20 which is formed integrally with the bottom so as to rise from an outer circumference of the bottom. The hook body 4 has a slightly larger diameter than the bobbin case holder 2. The peripheral wall 20 includes a part formed into a needle-thread passing opening 22 through which a needle thread seized by the beak member 5 passes, as shown in FIGS. 5 to 7. The wall 20 is further formed with an enlarged opening 23 (see FIG. 5) which is continuous to the side of the opening 22 opposed to the rotation direction A of the rotating hook and into which the beak member 5 is attached. Furthermore, the peripheral wall 20 has an upper end formed with an annular sliding surface 24 which is located at the inner peripheral side and is lower by one step than the top except for the openings 22 and 23. The bobbin case holder 2 has a lower end placed on the sliding surface 24 so as to be slidable thereon as shown in FIGS. 2 and 12, whereupon the bobbin case holder 2 is adapted to be accommodated in the rotating hook 3 while floating slightly away from the bottom 21. Dashed line K in FIGS. 10 and 11 designates a movement locus of the lower end of the outer periphery of the bobbin case holder 2 sliding on the sliding surface 24.

Referring now to FIGS. 5 and 6, the drive shaft 6 is formed into the shape of a pipe and has a shaft hole 6*a* (See FIG. 5) vertically extending therethrough. The drive shaft 6 further has a worm-gear-like gear formed on the outer circumference thereof. A rotating hook shaft (not shown) is adapted to be inserted through the shaft hole 6*a*. The rotating hook shaft has a lower end fixed to a sewing machine frame (the bottom of the bed 52), thereby rotatably supporting the rotating hook 3. The gear of the drive shaft 6 is brought into mesh engagement with a driving gear of a hook driving mechanism (not shown) so that the rotating hook 3 is rotated via the aforesaid driving gear and drive shaft 6 in the hook rotating direction A.

The beak member 5 is a component separate from the hook body 4 and is detachably attached to the hook body 4 in the embodiment. A mounting structure for the beak member 5 will be described in detail. The construction of the beak member 5 will firstly be described. The beak member 5 has a height equal to that of the outer circumferential wall 20 and is formed into the shape of a plate curved at the same curvature as the wall 20 as viewed from above, as shown in FIGS. 5 and 10 to 12. The beak member 5 is sized so as to close the aforesaid enlarged opening 23. The beak member 5 has substantially a lower half serving as a support wall 31 and an upper half serving as a beak peripheral wall 32 located at the outer periphery side of the lace 24.

The beak peripheral wall 32 has an upper face including a forward side with respect to a rotation direction A of the rotating hook as shown in FIG. 12. A guide face 32*d* is formed on the forward side of the upper face of the beak peripheral wall 32. The beak peripheral wall 32 further has a rearward side upper end formed with an outwardly protruding thread engagement step 32*c* as shown in FIG. 5. The thread engagement step 32*c* is provided for engaging and locking the needle thread loop.

The beak peripheral wall 32 also has an inner periphery including a horizontal thin plate-shaped beak body 33 formed integrally with the wall 32 so as to be located near to the lower side of the lace 24 (the side lower than the chain line K) as shown in FIGS. 4, 6 and 10 to 12. The beak body 33 has a forward side end with respect to the rotation direction A of the rotating hook. The forward side end of the beak body 33 is formed so as to extend toward the forward side by a predetermined dimension and so as to protrude inward. The beak peripheral wall 32 and beak body 33 constitute the thread capturing beak. Furthermore, two positioning pins 37 extend downward from the underside of the support wall 31 of the beak member 5 as shown in FIGS. 5 and 12.

Figure 10:
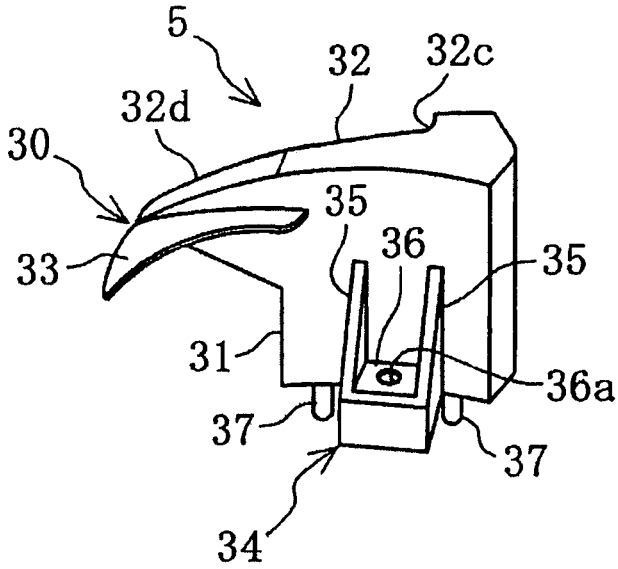
FIG. 10 is a perspective view of a beak.

A fixing block 34 is integrally formed on the inner periphery of the support wall 31 as shown in FIG. 10. The fixing block 34 includes a bottom 36 mounted on the lower end of the support wall 31 and a pair of substantially triangular side walls 35 extending from opposite ends of the bottom 36. The bottom 36 is formed into a rectangular shape and has a centrally located fixing screw hole 36*a*.

Figure 8:
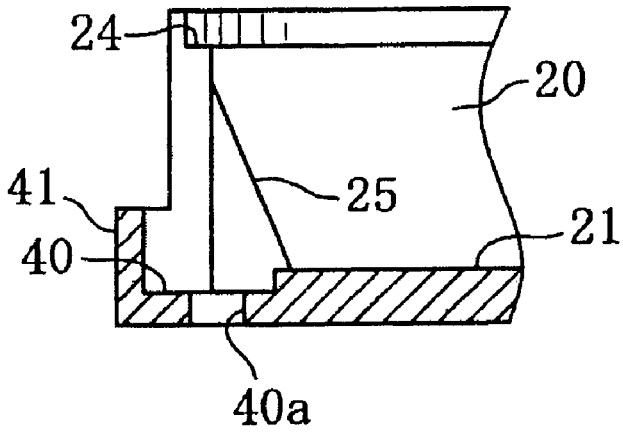
FIG. 8 is a view taken along line 8-8 in FIG. 7.
Figure 9:
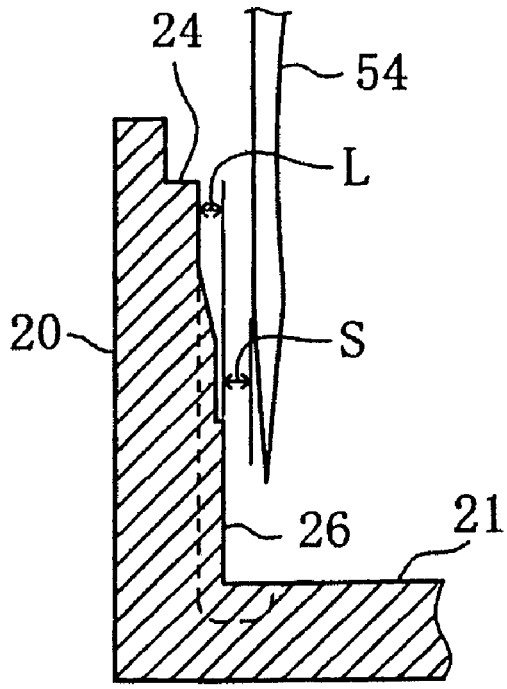
FIG. 9 is a view taken along line 9-9 in FIG. 7.

On the other hand, the hook body 4 is provided with a fitting holder 43 for holding the beak member 5. The fitting holder 43 includes a reinforcing peripheral wall 41 protruding outward from the peripheral wall 20 of the hook body 4 and supporting a lower outer face of the beak member 5 as shown in FIGS. 7 and 8. The fitting holder 43 further includes a reinforcing bottom 40 which is continuous to the bottom 21 and constitutes the bottom of the fitting holder 43. Furthermore, the reinforcing peripheral wall 41 has an end having an inner reinforcing wall 42 which is formed adjacent to the inner face of the beak member 5 so as to be parallel with the reinforcing peripheral wall 41. Each of the peripheral walls 41 and 42 has a height set to about one third of the height of the peripheral wall 20, for example. The reinforcing peripheral wall 41 has both ends continuous to the peripheral wall 20. Furthermore, the reinforcing peripheral wall 41 has a corner located at the forward side with respect to the rotation direction A of the rotating hook as shown only in FIG. 7. A columnar corner support 41*a* is formed on the corner so as to be located at the reinforcing bottom 40 side. Thus, the corner support 41*a*, reinforcing peripheral wall 41 and inner reinforcing wall 42 are abutted against the upwardly inserted beak member 5, thereby holding the beak member 5 in a vertical position.

On the other hand, the reinforcing bottom 40 continuous to the bottom 21 is formed into a generally T-shape as viewed on a plane so as to be located slightly lower than the bottom 21. The reinforcing bottom 40 has a screw hole 40*a* formed an inner part thereof so that the screw hole 40*a* corresponds to the screw hole 36*a* of the fixing block 34 of the beak member 5. The reinforcing bottom 40 further has a circular pin hole 40*b* for positioning the beak member 5 and an elongate circular pin hole 40*c* which is slightly longer laterally than the pin hole 40*b*. Accordingly, even if the distance between the positioning pins 37 has a dimensional error, the error can be absorbed by the elongate pin hole 40*c*. Consequently, the beak member 5 can be mounted on the rotating hook 3 reliably and accurately.

The beak member 5 is fitted into a fitting holder 43 provided on the hook body 4 from above thereby to be mounted on the hook body 4, as shown in FIG. 5. In this case, the two positioning pins 37 formed on the lower end of the beak member 5 are inserted into the pin holes 40*b* and 40*c* formed in the reinforcing bottom 40 respectively while the beak member 5 is guided by a reinforcing peripheral wall 41 and an inner reinforcing wall 42, whereby the beak member 5 is fitted in the fitting holder 43. Consequently, the beak member 5 can easily be positioned.

The fixing screw 38 is inserted through the screw hole 40*a* from below and screwed into the screw hole 36*a* of the fixing block 34 (see FIG. 5), whereby the beak member 5 is adapted to be fixed to the rotating hook 3. Consequently, the beak member 5 can be fixed stably and mounted reliably. Furthermore, since the two positioning pins 37 are engaged with the pin holes 40*b* and 40*v* respectively, the strength of the rotating hook 3 can be increased so as to resist an instantaneous external stress even when thread entanglement or the like subjects the beak member 5 to the instantaneous external stress outwardly traveling. Moreover, in this case, the corner support 41*a*, the reinforcing peripheral wall 41 and the inner reinforcing wall 42 are abutted against the beak member 5, thereby holding the beak member 5 in a vertical position. Consequently, since the beak member 5 is reinforced by the aforesaid abutment, the strength to overcome the above-described external stress can be ensured.

Furthermore, since the beak member 5 is mounted on the hook body 4 so as to close the enlarged opening 23, the thickness of the peripheral wall 20 need not be increased. Accordingly, the beak member 5 can be constituted as a member separate from the hook body 4 while an increase in the size of the rotating hook 3 is limited. Additionally, since the beak member 5 can be replaced individually, a replacing work can be simplified and accordingly, the maintenance cost can be reduced.

A plurality of inclined surfaces 32*a*, 33*a*, 20*a* and 20*b* are adapted to be formed on the beak member 5 and the peripheral wall 20 of the hook body 4 in the injection molding in the embodiment. More specifically, as shown in FIG. 11, the first inclined face 32*a* is formed on a forward end of the beak peripheral wall 32 with respect to the rotation direction A of the rotating hook 3. The first inclined face 32*a* is inclined forwardly outward. Furthermore, the second inclined face 33*a* is formed on a forward end of the beak body 33 with respect to the rotation direction A of the rotating hook 3 as shown in FIG. 11. The second inclined face 33*a* is inclined forwardly downward.

On the other hand, the third inclined face 20*a* is formed on an inner peripheral edge of the peripheral wall 20 fronting to the enlarged opening 23 and the beak member 5 as shown in FIGS. 6 and 11. The third inclined face 20*a* is gently inclined forwardly outward. Furthermore, as shown in FIG. 12, the fourth inclined face 20*b* is formed on a forward edge of the lace 24. The fourth inclined face 20*b* is inclined forwardly downward. The bobbin case holder 2 can smoothly be slid on the sliding surface 24 without collision against the beak member 5 and the peripheral end as the result of formation of the inclined surfaces 32*a*, 33*a*, 20*a* and 20*b*.

The rotating hook 3 is formed with first and second reinforcing ribs 25 and 26 both located at an inner surface of the peripheral wall 20 of the hook body 4 and extending longitudinally as shown in FIG. 11. Each rib interconnects outer peripheries of the peripheral wall 20 and the bottom 21 and comes closer to the peripheral wall 20 as a height thereof is increased. Thus, each of the reinforcing ribs 25 and 26 is formed into such a generally triangular shape that each reinforcing rib interconnects the peripheral wall 20 and an outer periphery of the bottom 21 of the rotating hook 3 and a sectional area of each reinforcing rib is rendered smaller as a height of each reinforcing rib is increased. Each reinforcing rib is formed integrally with the hook body 4 by injection molding, for example. The reinforcing ribs 25 and 26 are disposed so that the needle-thread passing opening 22 and the enlarged opening 23 are located between the ribs 25 and 26. More specifically, the first reinforcing rib 25 is located in the vicinity of the peripheral end of the peripheral wall 20 defining the enlarged opening 23 whereas the second reinforcing rib 26 is located in the vicinity of the peripheral end of the needle-thread passing opening 22. The second reinforcing rib 26 is sized so that a predetermined space S is defined between the sewing needle 54 and the rib 26. The second reinforcing rib 26 has a dimension L of inward protrusion which is set so that the rib 26 is prevented from contact with the needle 54.

An operation and effect of the horizontal full rotary hook 1 constructed above will now be described. In the embodiment, the first reinforcing rib 25 is provided integrally on the end of the peripheral wall 20 of the hook body 4 facing the enlarged opening 23, and the second reinforcing rib 26 is provided integrally on the end of the peripheral wall 20 facing the needle-thread passing opening 22. Consequently, the strength of each of the ends facing the openings 22 and 23 of the peripheral wall 20 of the hook body 4 can be increased without an increase in the thickness of each end.

According to the horizontal full rotary hook 1 of the embodiment, in the construction that the rotating hook 3 (hook body 4) is made of the synthetic resin, the strength of the peripheral wall 20 of the hook body 4 can be improved while the size of the rotating hook 3 is prevented from being increased and accordingly, occurrence of deformation or breakage can be prevented even when the peripheral wall 20 is subjected to an external force.

Figure 4:
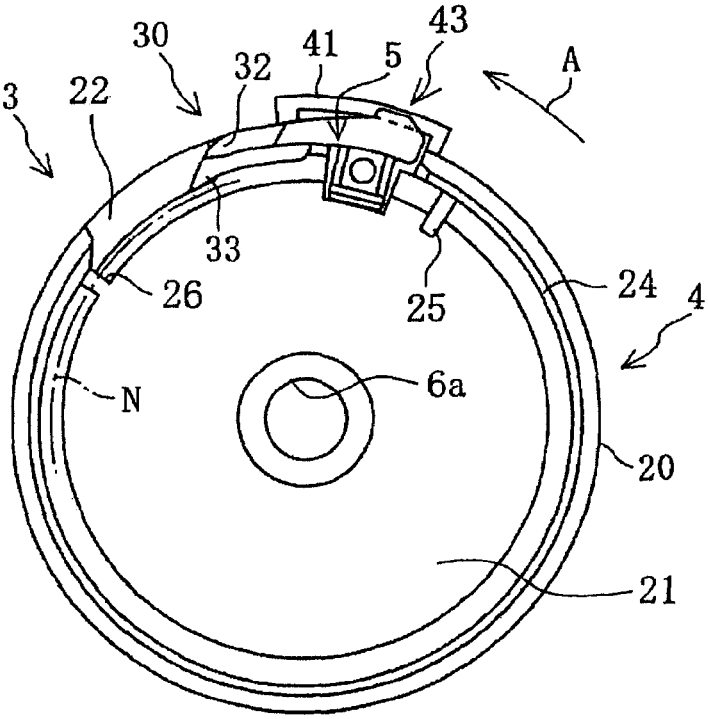
FIG. 4 is a plan view of an outer rotating hook.

FIGS. 4 and 6 show a movement locus of the sewing needle 54 relative to the rotating hook 3 by chain line. As shown in the figures, the sewing needle 54 is vertically moved inside the peripheral wall 20 along the wall 20. When the needle 54 drops to the lowermost point, the second reinforcing rib 26 is located in the vicinity of the sewing needle 54. However, the second reinforcing rib 26 does not interfere with the sewing needle 54 since the space S is defined so that the second reinforcing rib 26 is prevented from interfering with the sewing needle 54. Thus, the reinforcing ribs 25 and 26 can be located on the inside of the peripheral wall 20 while the interference between the second reinforcing rib 26 and the sewing needle 54. Consequently, the reinforcing ribs 25 and 26 on the inside of the wall 20 are subjected to tensile force when an outwardly traveling force acts on the peripheral wall 20. However, the reinforcing ribs 25 and 26 can sufficiently resist the tensile stress, whereupon the peripheral wall 20 exhibits a high reinforcing effect.

Figure 13:
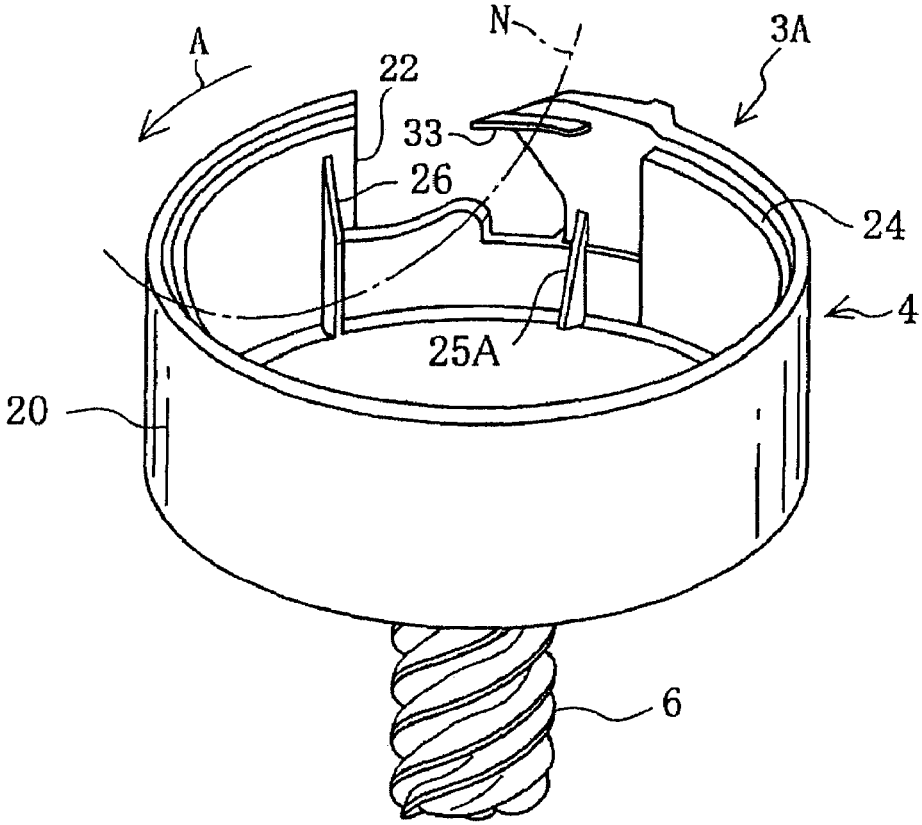
FIG. 13 is a view similar to FIG. 6, showing a second illustrative aspect of the invention.

FIG. 13 illustrates a second embodiment of the invention. Differences of the second embodiment from the first embodiment will be described. Identical or similar parts in the second embodiment are labeled by the same reference symbols as those in the first embodiment.

The rotating hook 3A in the second embodiment includes the beak member 5 provided integrally on the hook body 4 by the injection molding, for example. More specifically, portions corresponding to the beak peripheral wall 32 and the support wall 31 are continuous integrally to the peripheral wall 20. Furthermore, the peripheral wall 20 is formed with the needle-thread passing opening 22. In this case, the reinforcing ribs 25A and 26 are provided on the inside of the peripheral wall 20 so as to be located in the vicinity of the peripheral ends defining the opening 22 respectively. As a result, the first reinforcing rib 25A is located below the beak body 33.

According to the embodiment, the production cost of the horizontal rotary hook can be reduced since the rotating hook 3 with the beak can be made by a single injection molding. As a result, the production cost can be reduced. Additionally, the strength of each of the ends of the peripheral wall 20 defining the needle-thread passing opening 22 can be increased in the rotating hook 3 formed with the needle-thread passing opening 22 in the peripheral wall 20 while an increase in the thickness of the peripheral wall 20 is limited.

Figure 14:
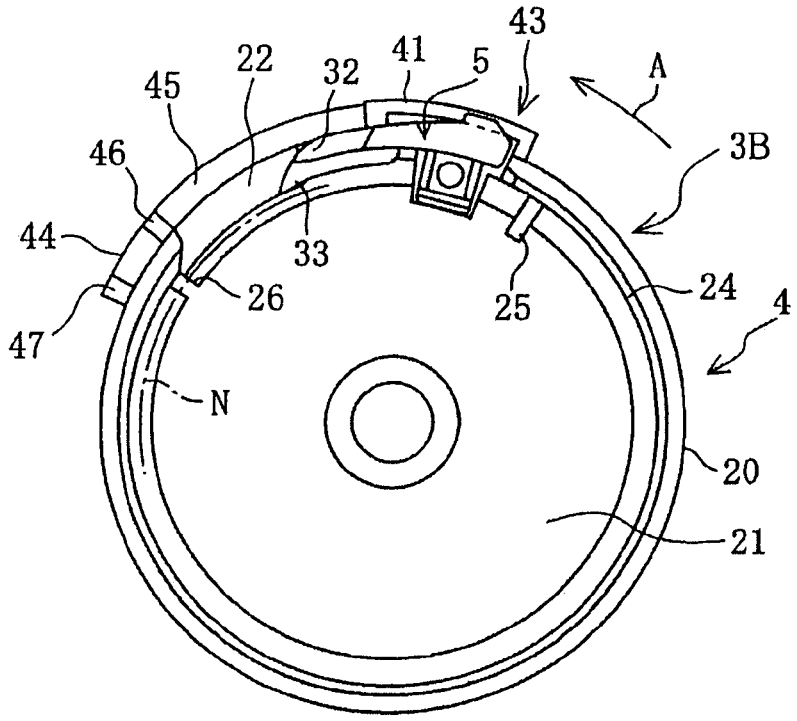
FIG. 14 is a view similar to FIG. 4, showing a third illustrative aspect of the invention.
Figure 15:
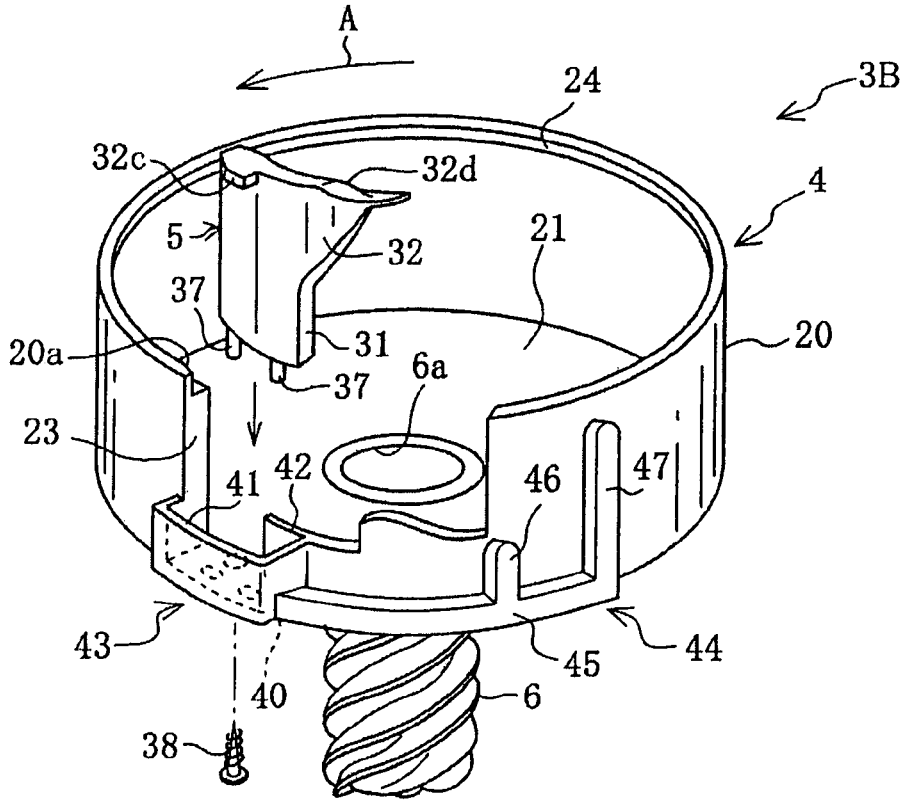
FIG. 15 is a view similar to FIG. 5.

FIGS. 14 and 15 illustrate a third embodiment of the invention. Differences of the third embodiment from the first embodiment will be described. Identical or similar parts in the third embodiment are labeled by the same reference symbols as those in the first embodiment.

In the third embodiment, a third reinforcing rib 44 is provided on the outside of the peripheral wall 20 of the rotating hook 3B in addition to the above-described reinforcing ribs 25 and 26, as shown in FIGS. 14 and 15. The third reinforcing rib 44 is formed into the shape of "F" fallen down sideways and provided integrally on the hook body 4 by the injection molding. More specifically, the third reinforcing rib 44 includes a lateral rib 45 extending forward from the fitting holder 43 a quarter turn with respect to the rotation direction A of the rotating hook 3 and a longitudinal ribs 46 and 47 both extending upward from the lateral rib 45. The longitudinal rib 47 formed at the forward side with respect to the rotation direction of the rotating hook 3 so as to extend substantially to an upper end of the peripheral wall 20 as shown in FIG. 15. The other longitudinal rib 26 is formed so as to be shorter than the longitudinal rib 47. Furthermore, the third reinforcing rib 44 has a dimension of outward protrusion from the peripheral wall 20. The dimension of the rib 44 is set to be slightly smaller than that of the reinforcing peripheral wall 41.

According to the third embodiment, the strength of the ends of the peripheral wall can further be increased since the rotating hook 3B is provided with the third reinforcing rib 44 as well as the reinforcing ribs 25 and 26. Furthermore, the third reinforcing rib 44 can be prevented from interfering with external during rotation of the rotating hook 3 since the dimension of outward protrusion of the third reinforcing rib 44 is relatively smaller. Accordingly, since the longitudinal rib 47 can be formed so as to extend substantially to the upper end, the strength of the peripheral wall 20 can effectively be increased.

Modified forms of the foregoing embodiments will now be described. The second reinforcing rib 26 may be eliminated with provision of the first and third reinforcing ribs 25 and 44 in the third embodiment. Furthermore, the beak member 5 may be made of a metal. The first reinforcing rib 25A in the second embodiment may be located at the same position as the first reinforcing rib 25 in the first embodiment. Additionally, the reinforcing ribs 25 and 26 should not be limited to the triangular shape but may be formed into a prismatic shape with a rectangular section, a columnar shape with a circular or elliptic section or the like.

The invention may be various types of horizontal rotary hooks such as half rotary hooks.

The foregoing description and drawings are merely illustrative of the principles of the present invention and are not to be construed in a limiting sense. Various changes and modifications will become apparent to those of ordinary skill in the art. All such changes and modifications are seen to fall within the scope of the invention as defined by the appended claims.

What is claimed is:

1. A horizontal rotary hook for a sewing machine, comprising:

a bobbin case holder accommodating a bobbin;

a rotating hook made of a synthetic resin, and accommodating the bobbin case holder and rotated in a predetermined direction, the rotating hook including a peripheral wall and a peripheral end;

a needle-thread passing opening formed in the peripheral wall of the rotating hook so as to be defined at least by a peripheral end of the peripheral wall; and a reinforcing rib provided on the peripheral wall of the rotating hook so as to be located in the vicinity of the peripheral end defining the needle-thread passing opening, said reinforcing rib being provided on an inner surface of the peripheral wall and interconnecting the peripheral wall and an outer periphery of the bottom of the rotating hook.

2. The horizontal rotary hook according to claim 1, wherein the reinforcing rib is provided on an inner surface of the peripheral wall.

3. The horizontal rotary book according to claim 1, wherein the reinforcing rib is formed into such a generally triangular shape that the reinforcing rib interconnects the peripheral wall and an outer periphery of the bottom of the rotating hook and a sectional area of the reinforcing rib is rendered smaller as a height of the reinforcing rib is increased.

4. The horizontal rotary hook according to claims 1, wherein the reinforcing rib is sized so that a gap is defined between a sewing needle and the reinforcing rib in sewing.

5. A horizontal rotary hook for a sewing machine, comprising:

a bobbin case holder accommodating a bobbin;

a rotating hook made of a synthetic resin, and accommodating the bobbin case holder and rotated in a predetermined direction, the rotating hook including a peripheral wall and a peripheral end;

a needle-thread passing opening formed in the peripheral wall of the rotating hook so as to be defined at least by a first peripheral end of the peripheral wall;

an enlarged opening formed in the peripheral wall of the rotating hook so as to be defined at least by a second peripheral end of the peripheral wall of the rotating hook and so as to be continuous to the needle-thread passing opening;

a beak member separate from the rotating hook and mounted on the rotating hook so as to close the enlarged opening; and reinforcing ribs provided on the peripheral wall of the rotating hook so as to be located in the vicinity of at least one of the first peripheral end defining the needle-thread passing opening and the second peripheral end defining the enlarged opening, said reinforcing ribs being provided on an inner surface of the peripheral wall and interconnecting the peripheral wall and an outer periphery of the bottom of the rotating hook.

6. The horizontal rotary hook according to claim 5, wherein the reinforcing rib is provided on an inner surface of the peripheral wall.

7. The horizontal rotary hook according to claim 5, wherein the reinforcing ribs is formed into such a generally triangular shape that the reinforcing ribs interconnects the peripheral wall and an outer periphery of the bottom of the rotating hook and a sectional area of the reinforcing ribs is rendered smaller as a height of the reinforcing rib is increased.

8. The horizontal rotary hook according to claim 5, wherein the reinforcing rib is sized so that a gap is defined between a sewing needle and the reinforcing rib in sewing.

9. The horizontal rotary hook according to claim 5, wherein the beak member is made of a synthetic resin.

* * * * *